US006642668B2

(12) United States Patent
Toyama et al.

(10) Patent No.: US 6,642,668 B2
(45) Date of Patent: Nov. 4, 2003

(54) DISCHARGE LAMP DEVICE FOR REDUCING NOISE RADIATION AND SURGE PULSE CURRENT

(75) Inventors: Koichi Toyama, Kariya (JP); Hironao Yamaguchi, Gamagori (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/228,266

(22) Filed: Aug. 27, 2002

(65) Prior Publication Data

US 2003/0052624 A1 Mar. 20, 2003

(30) Foreign Application Priority Data

Aug. 27, 2001 (JP) ..... 2001-256772

(51) Int. Cl.[7] ..... H05B 37/02
(52) U.S. Cl. ..... 315/224; 315/307; 315/DIG. 7
(58) Field of Search ..... 315/77, 82, 85, 315/224, 225, 209 T, 276, 277, 291, 307, DIG. 2, DIG. 5, DIG. 7; 307/10.1, 10.6, 10.8; 323/901; 361/679, 816, 818; 363/132

(56) References Cited

U.S. PATENT DOCUMENTS 5,384,518 A * 1/1995 Kido et al. ..... 315/225
5,706,185 A * 1/1998 Toyama et al. ..... 315/127
6,066,921 A * 5/2000 Nakamura et al. ..... 315/71
6,072,277 A 6/2000 Yamamoto et al. ..... 315/82
6,201,350 B1 3/2001 Okuchi et al. ..... 315/82
6,333,607 B1 12/2001 Yamamoto et al. ..... 315/307

* cited by examiner

*Primary Examiner*—Hoang Nguyen
*Assistant Examiner*—Thuy Vinh Tran
(74) *Attorney, Agent, or Firm*—Posz & Bethards, PLC

(57) ABSTRACT

Providing a discharge lamp device to reduce noise radiation and to reduce a surge pulse current resulting from a shield sheath involves providing a ballast, including a DC/DC conversion circuit for boosting a direct current voltage from a battery, an inverter circuit for converting the voltage boosted by the DC/DC conversion circuit into an alternating current voltage, a starting circuit having a second transformer for boosting to such a voltage that causes a breakdown between electrodes of a lamp in starting up the lamp, and a metal case for accommodating the DC/DC conversion circuit, the inverter circuit, and the starting circuit. A secondary winding of the second transformer of the starting circuit is connected between the lamp and the inverter circuit connected to the lamp. An electrode member is interposed between the second transformer and the metal case.

13 Claims, 4 Drawing Sheets

DISCHARGE LAMP DEVICE FOR REDUCING NOISE RADIATION AND SURGE PULSE CURRENT

CROSS REFERENCE TO RELATED APPLICATION

This application is based upon, claims the benefit of priority of, and incorporates by reference the contents of prior Japanese Patent Application No. 2001-256772 filed Aug. 27, 2001.

BACKGROUND OF THE INVENTION

1. Technical Field of the Invention

The invention relates to a discharge lamp device for lighting a high voltage discharge lamp. Specifically, the device is applicable to an automotive headlight device employing a discharge lamp.

2. Description of Related Art

In general, among the discharge lamp devices is a vehicle-mounted discharge lamp device which comprises a DC/DC converter for boosting a voltage supplied from an external power source, an inverter circuit for converting the boosted voltage into an alternating current voltage, and a starting circuit for producing high voltage to begin lighting a discharge lamp.

This starting circuit is provided with a high voltage transformer for causing a spark discharge so that a breakdown occurs between the electrodes of the discharge lamp. The high voltage transformer is composed of a primary winding and a secondary winding, and the secondary winding is connected between the discharge lamp and the inverter circuit.

In addition, wiring extending from the high voltage transformer to the discharge lamp is covered with a shield sheath in order to prevent noise radiation resulting from restriking noises that occur when the current flowing through the discharge lamp alternates in direction. The shield sheath also prevents noise radiation resulting from the alternating current flowing through the wiring that leads to the discharge lamp, upon alternating-current driving of the discharge light by the inverter circuit. Additionally, for the prevention of noise radiation, the high voltage transformer and the electronic circuits connected to the high voltage transformer, such as the inverter circuit, are typically accommodated in an electronic circuit case made of metal and are grounded along with the shield sheath.

In the conventional configuration, the shield sheath structure causes ground stray capacitances not only of the wiring between the discharge lamp and the high voltage transformer but also of the high voltage transformer. Consequently, when the high voltage transformer produces a high voltage at the start of lighting, the voltage to be applied to the discharge lamp charges these ground stray capacitances while being boosted. Subsequently, when the voltage reaches a high voltage and is applied to the discharge lamp for breakdown, the electric charges of the ground stray capacitance, having been charged up, then flow as a surge pulse current. In some cases, semiconductor switching devices, and the like, in the inverter circuit for converting a direct current voltage into an alternating current voltage may be broken.

SUMMARY OF THE INVENTION

The present invention has been achieved in view of the foregoing, and it is thus an object thereof to provide a discharge lamp device which can reduce noise radiation and reduce the surge pulse current resulting from the shield sheath.

According to a first aspect of the present invention, a lighting control circuit is provided including: a DC/DC conversion circuit having a first transformer for boosting a direct current voltage from a direct current power source; an inverter circuit having a semiconductor switching device for converting the voltage boosted by the DC/DC conversion circuit into an alternating current voltage; a starting circuit having a second transformer for boosting to such a voltage so as to cause a breakdown between electrodes of a discharge lamp in starting up the discharge lamp; and an electronic circuit case for accommodating the DC/DC conversion circuit, the inverter circuit, and the starting circuit. A secondary winding of the second transformer of the starting circuit is connected between the discharge lamp and the inverter circuit connected to the discharge lamp. An electrode member is interposed between the second transformer and the electronic circuit case.

Consequently, the interposition of the electrode member between the second transformer and the electronic circuit case allows suppression of a stray capacitance lower than the ground stray capacitance in the conventional configuration where the second transformer and the electronic circuit case are grounded therebetween.

It is therefore possible to reduce the stray capacitance to be charged when the second transformer produces a high voltage during startup. Thus, after a breakdown occurs between the electrodes of the discharge lamp, the amount of discharge of the electric charges, having been accumulated in the stray capacitances up to then, can be reduced with a reduction in surge pulse current.

In another aspect of the present invention, the electrode member is connected to a low-voltage side of the secondary winding of the second transformer. Consequently, even if such a high voltage, so as to cause a breakdown between the electrodes of the discharge lamp, is produced by the second transformer during startup, the connection of the electrode member to the low-voltage side of the secondary winding of the second transformer can surely reduce the stray capacitance that occurs in the second transformer.

In another aspect of the present invention, the electrode member is interposed at least between the secondary winding of the second transformer and the electronic circuit case. That is, to reduce the stray capacitance that occurs in the second transformer, the electrode member only has to be interposed between the second winding, which produces a high voltage, and the electronic circuit case. This will decrease waste of the electrode member used to reduce the stray capacitance.

In another aspect of the present invention, the electrode member is formed by evaporating a metal layer onto an insulating film. Consequently, the electrode member to be interposed between the second transformer and the electronic circuit case can be fabricated at a low cost without increasing the complexity or number of parts of the discharge lamp device, in particular, around the electronic circuit case.

In another aspect of the present invention, the electrode member is folded in two to cover both sides of the second transformer accommodated in the electronic circuit case. Since the second transformer accommodated in the electronic circuit case is covered at both sides with the folded electrode member, the ground stray capacitance of the second transformer can be eliminated.

According to another aspect of the present invention, the lighting control circuit is connected directly to the discharge lamp. This eliminates the need for the wiring from the second transformer of the starting circuit, constituting the lighting control circuit, to the discharge lamp, i.e., the shield sheath. It is therefore possible to reduce the surge pulse current resulting from the shield sheath while simplifying the discharge lamp device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

First Embodiment

Figure 1:
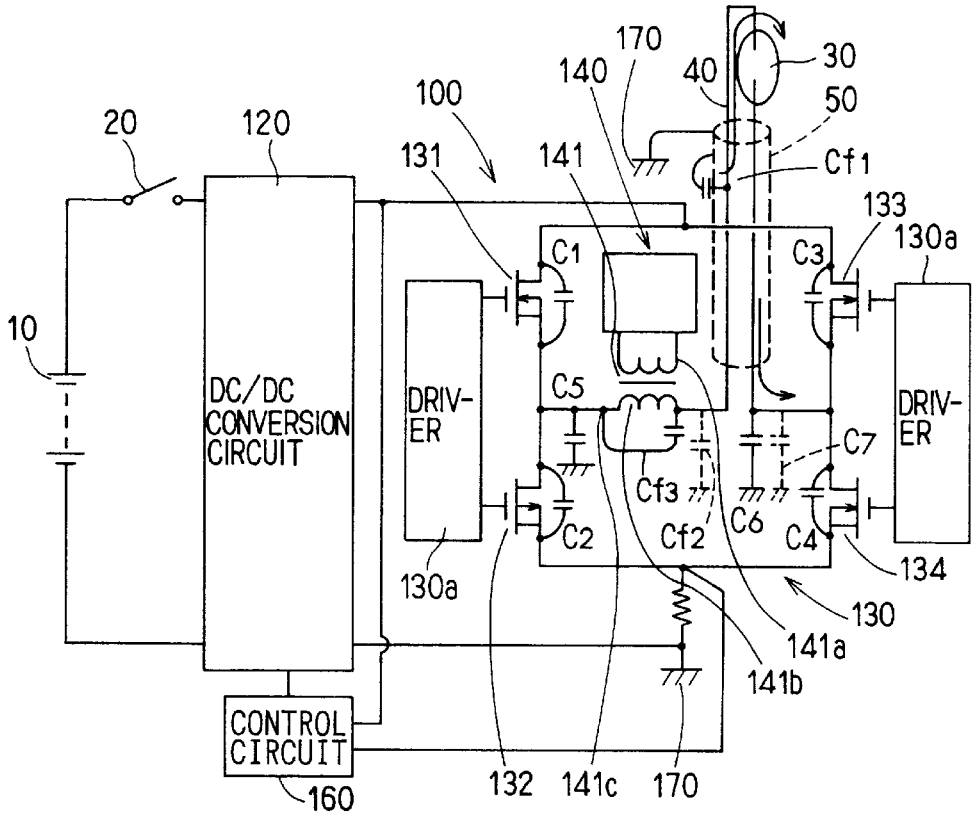
FIG. 1 is a block diagram showing the circuit configuration of a discharge lamp device according to a first embodiment of the present invention.
Figure 3:
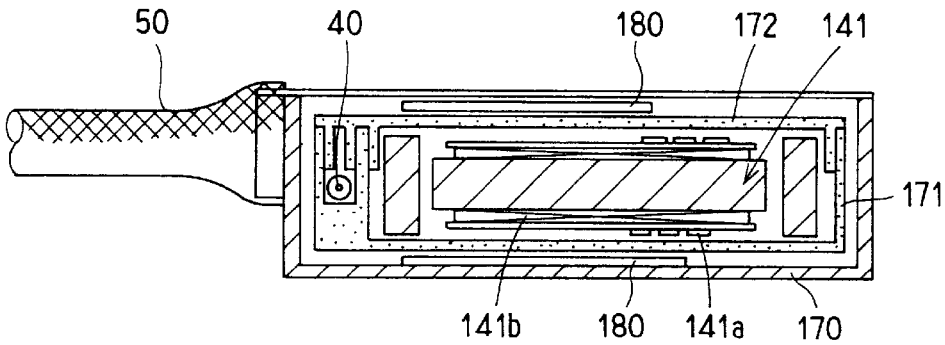
FIG. 3 is a cross-sectional view as seen from III—III in FIG. 2.
Figure 2:
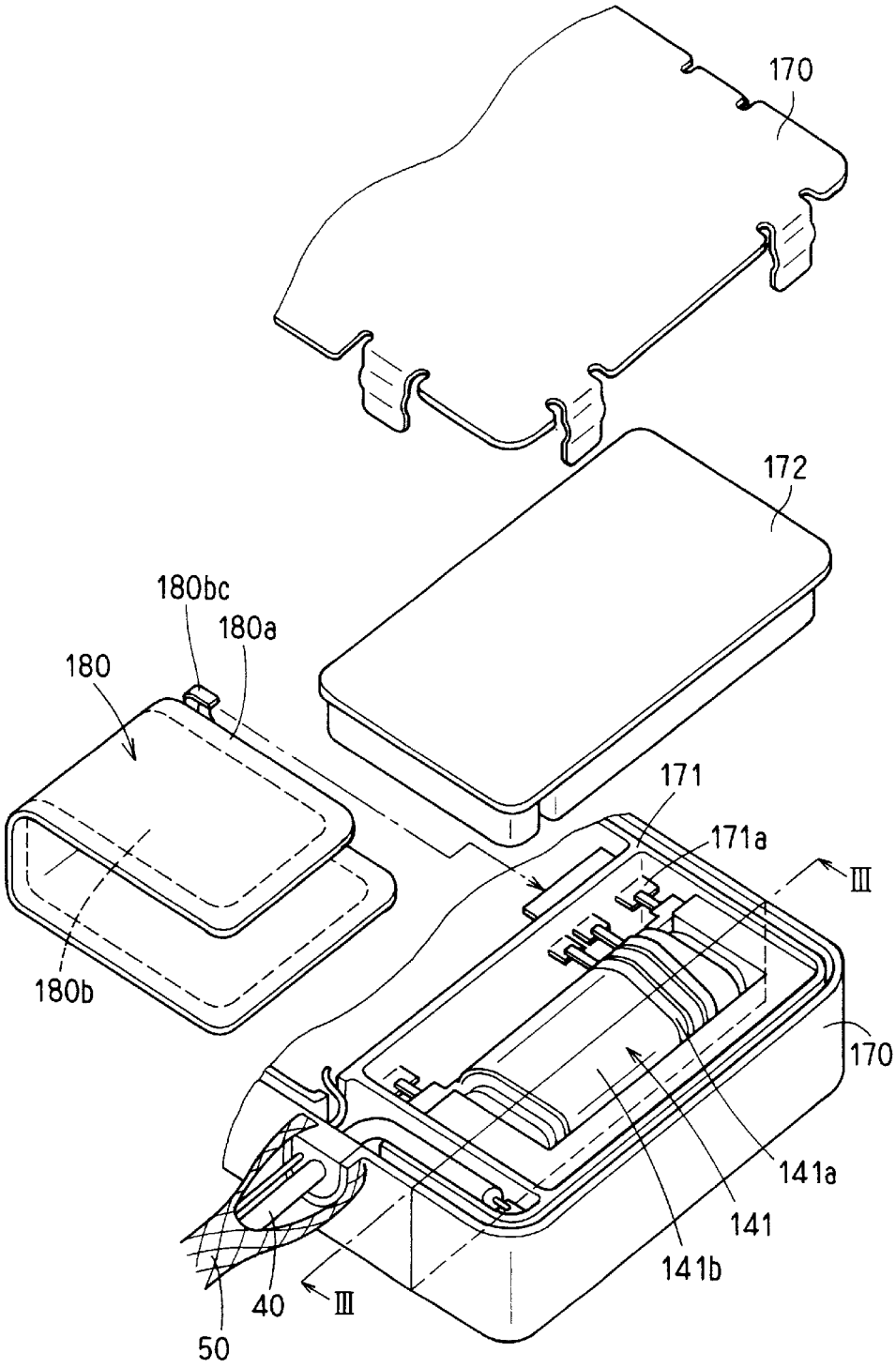
FIG. 2 is a partial, exploded perspective view showing the configuration of the lighting control circuit of FIG. 1.

With reference to FIGS. 1 to 3, description will be given of a first embodiment of the present invention in which the discharge lamp device is applied to an automotive discharge lamp device. FIG. 1 is a block diagram showing the circuit configuration of the discharge lamp device according to a first embodiment. FIG. 2 is a partial, exploded perspective view showing the configuration of the lighting control circuit shown in FIG. 1. FIG. 3 is a cross-sectional view as seen from III—III of FIG. 2.

As shown in FIG. 1, the discharge lamp device comprises a direct current power source or battery 10, a lighting switch 20, and a lighting control circuit (hereinafter, referred to as a ballast) 100 which lights a lamp 30 with an alternating current based on a boosted voltage of the direct current voltage from the battery 10 when the lighting switch 20 is ON.

This ballast 100 includes a DC/DC conversion circuit 120, an inverter circuit 130, a starting circuit 140, a control circuit 160, and an electronic circuit case 170. Incidentally, in this instance, the lamp 30 is a discharge lamp such as a metal halide lamp which is an automotive headlight. During startup, the starting circuit 140 applies a high voltage that causes a breakdown between electrodes of the lamp 30. After a breakdown, the unstable glow discharge transforms into arc discharge for a stable lighting state.

The DC/DC conversion circuit 120 is also provided with a first transformer (not shown) having a primary winding (not shown) arranged on the side of the battery 10 and a secondary winding (not shown) arranged on the side of the lamp 30. Semiconductor switching devices (not shown), such as MOS transistors, connected to the primary winding are turned ON/OFF by the control circuit 160 so that the direct current voltage from the battery 10 is boosted for a high voltage output.

The inverter circuit 130 has MOS transistors 131–134 which form semiconductor switching devices arranged in an H bridge. Drive circuits 130*a* alternately turn ON/OFF the MOS transistors 131–134 of diagonal relationships so that the lamp 30 is driven to light with an alternating current.

The starting circuit 140 connects to a point between the inverter circuit 130 and the lamp 30, comprises a second transformer 141 having a primary winding 141*a* and a secondary winding 141*b*, a capacitor (not shown), and a thyristor (not shown) as a unidirectional semiconductor device, and starts the lamp 30 to light it. That is, when the lighting switch 20 is turned ON, the capacitor is charged. Subsequently, when the thyristor is turned ON, the capacitor discharges to apply a high voltage (for example, 25 kV) to the lamp 30 through the second transformer 141. As a result, the lamp 30 causes a breakdown between its electrodes for spark ignition.

In the ballast 100 having the foregoing configuration, when the lighting switch 20 is turned ON, the DC/DC conversion circuit 120, having the first transformer, outputs a boosted voltage of the battery voltage. The high voltage output from this DC/DC conversion circuit 120 (around 300–500V in a preparatory stage of lighting, around 100 V after the start of lighting) is boosted by the second transformer 141 of the starting circuit 140 via the inverter circuit 130 to a higher voltage (for example, 25 kV) and applied to the lamp 30 so that a breakdown occurs. As a result, the lamp 30 begins to light.

With continuing reference to FIG. 1, the electrode member 180 is isolated from the electric circuit case 170. The electrode member 180 is electrically connected to the low voltage side terminal 141*c* of the secondary coil 141*b* as shown in FIG. 1, and conducts with the low voltage side terminal 141*c*. The electrode member 180 covers the transformer 141 and defines stray capacitance with the secondary coil 141*b* since the electrode member 180 is electrically connected to the low voltage side terminal 141*c*. The stray capacitance may be illustrated as a capacitor cf3 connected in parallel with the secondary coil 141*b*.

Now, the mounting structure of the ballast 100 will be described below with reference to FIGS. 2 and 3. As shown in FIG. 2, the ballast 100 has a metallic electronic circuit case (hereinafter, referred to as metal case) 170 in which the individual circuits, such as the starting circuit 140, are accommodated. The outer periphery of this metal case 170 is electrically connected to a shield sheath 50, which covers a high voltage cord 40 for connecting the lamp 30 and the transformer 141 of the starting circuit 140, and is grounded. Consequently, it is possible to avoid noise radiation resulting from restriking noises that occur when the current flowing through the lamp 30 alternates in direction and to eliminate noise radiation resulting from the alternating current flowing through the wiring (more specifically, the high voltage cord 40) that leads to the lamp 30, upon the alternating-current driving of the lamp 30 by the inverter circuit 130.

This metal case 170 also contains a resin case 171. Terminals 171*a* are insert-molded in the resin case 171.

Consequently, the parts that can be formed as semiconductor devices, such as the control circuit 160 and the MOS transistors, are integrated into an IC, or hybrid IC, and electrically connected to the transformer 141 through the terminals 171*a*.

Moreover, since the second transformer 141 of the starting circuit 140, or the secondary winding 141*a* in particular, outputs a high voltage (for example, 25 kV), the second transformer 141 is surrounded by the resin case 171 and a resin cover 172 as shown in FIG. 2 so that the high voltage is insulated. Here, in the discharge lamp device having the foregoing configuration, the shield sheath structure forms ground stray capacitances Cf1 and Cf2 not only from the high voltage cord 40 but also from the starting circuit 140 (more specifically, the second transformer 141) which is connected to the high voltage cord 40 (FIG. 1).

Additionally, this ground stray capacitance Cf1 is formed between the high voltage cord 40 and the shield sheath 50, and the ground stray capacitance Cf2 is formed between the second winding 141*b* of the second transformer 141 and the metal case 170. That is, when the second transformer 141 produces a high voltage at the start of lighting, the voltage to be applied to the lamp 30 charges these ground stray capacitances Cf1 and Cf2 while being boosted. Subsequently, when the voltage reaches a high voltage and causes a breakdown between the electrodes of the lamp 30 while the diagonal MOS transistors 131 and 134 are ON, for example, the charges having been accumulated as the ground stray capacitances Cf1 and Cf2 up to then flow as a surge pulse current in the direction of the arrows shown in FIG. 1.

In the worst case, this surge pulse current, when it flows, might flow through the H-bridged MOS transistors 131–134 of the inverter circuit 130 and break the MOS transistors 133 and 134, in particular. For this reason, protective capacitors C6 and C7 for bypassing this surge pulse current are typically connected to a connecting point between the electrode of the lamp 30 and the MOS transistors 133 and 134. For the same reason, protective capacitors C1–C4 and C5 are also arranged between the drains and sources of the respective transistors 131–134.

Meanwhile, according to the embodiment of the present invention, an electrode member 180 shown in FIG. 2 is interposed between the second transformer 141 and the metal case 170. This electrode member 180 is a thin conductor, such as copper foil, laminated with insulating films. Incidentally, a metal layer 180*b* of such a conductor as copper may be evaporated onto one side of a laminate 180*a*. That is, for the second transformer 141 surrounded by the resin film 171 and the resin cover 172, the electrode member 180 can be arranged between the resin cover 172 and the metal case 170 with its laminate portion toward the metal case 170 as shown in FIG. 3, so that the electrode member 180 secures insulation from the metal case while forming a stray capacitance Cf3 between the second transformer 141 and the electrode member 180 (FIG. 1).

Since the electrode member 180 is interposed between the second transformer 141 and the metal case 170, the ground stray capacitance Cf2 for situations where the second transformer 141 and the metal case 170 are grounded can thus be replaced with and suppressed to the stray capacitance Cf3 which is smaller than the ground stray capacitance Cf2. Incidentally, as shown in FIG. 1, stray capacitance Cf3 is desirably formed so that the metal layer 180*b* of the electrode member 180 is connected to the low-voltage side of the secondary winding 141*b* of the second transformer 141 through a connecting part 180*bc* and a terminal 171*a*. This can ensure a reduction in ground stray capacitance as compared to the conventional ground stray capacitance Cf2.

Consequently, adopting the configuration of the discharge lamp device of the present embodiment, or the ballast 100 in particular, allows a reduction in stray capacitance when the second transformer 141 produces a high voltage during startup. Thus, after a breakdown occurs between the electrodes of the lamp 30, the amount of discharge of the electric charges having been accumulated in the stray capacitances up to then can be reduced with a reduction in surge pulse current.

Moreover, the reduced surge pulse current prevents the switching devices such as the MOS transistors 131–134 from becoming broken. This allows a reduction of the parts count of protective capacitors for bypassing a surge pulse current. For example, a reduction of the protective capacitor C7 in FIG. 1, provided that the required capacities are secured by combinations of inexpensive capacitors.

In addition, if the second transformer 141 is surrounded by the resin cover 172 or the like for insulating the high voltage produced, the electrode member 180 is formed by evaporating the metal layer 180*b* onto the insulating film 180*a*. This allows inexpensive fabrication without increasing the constitution of the discharge lamp device, in particular, around the ballast 100.

Modified First Embodiment

In such configuration that the electrode member 180 shall be arranged on top and bottom, on both sides of the second transformer 141, the electrode member 180 is desirably folded in two and inserted above and below the second transformer 141 as shown in FIG. 2 so that the second transformer 141 accommodated in the metal case 170 is covered on both sides (see FIGS. 2 and 3). Then, in the process of assembly to cover both sides of the second transformer 141 (more specifically, via the resin cover 172 which surrounds the second transformer 141), the electrode member 180 can be easily mounted from one direction as shown in FIG. 2.

Second Embodiment

Figure 4A:
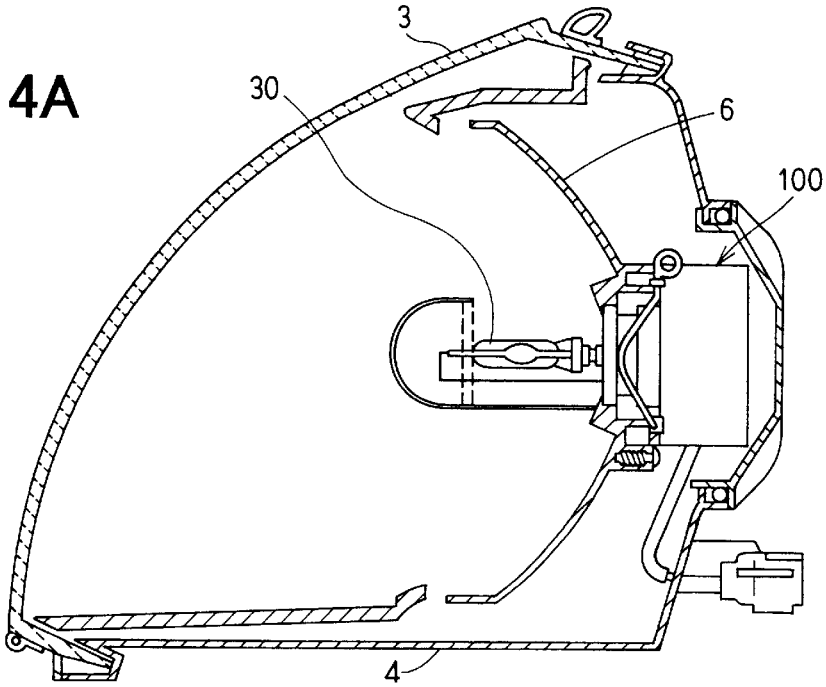
FIG. 4A is a cross-sectional view of the discharge lamp device according to a second embodiment of the present invention.

In a second embodiment of the present invention, the configuration such that the ballast 100 and the lamp 30 are connected with the high voltage cord 40, of the first embodiment, is replaced with the configuration that the ballast 100 is connected directly to the lamp 30 (see FIG. 4A). Incidentally, in FIG. 4A, the automotive discharge lamp device is configured so that the lamp 30 and a reflector 6 that has a reflecting mirror on its surface side are accommodated in a lamp chamber which is composed of a transparent lens 3 and a housing 4. In the present embodiment, this lamp chamber contains the ballast 100 so that the ballast 100 is located on the backside of the reflector 6.

Figure 4B:
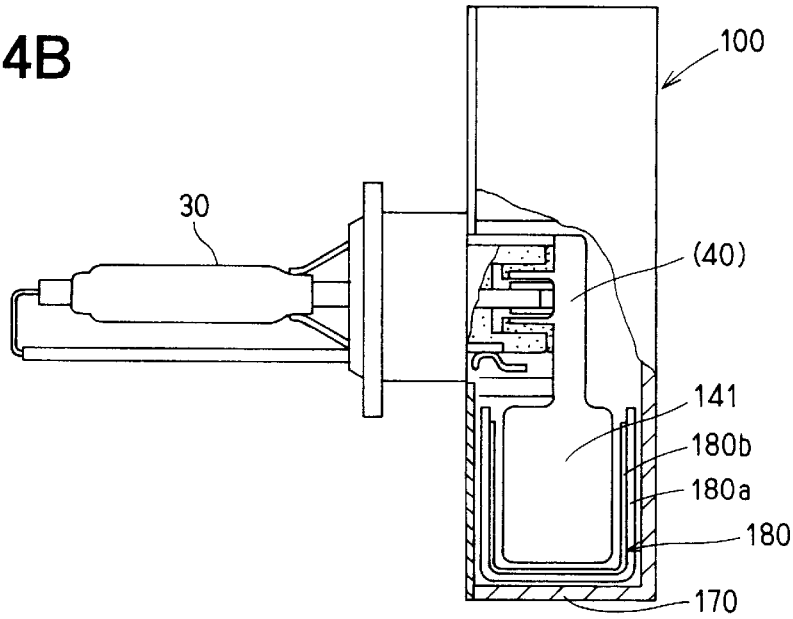
FIG. 4B is a partial cross-sectional view of the lighting control circuit of FIG. 4A.
Figure 5:
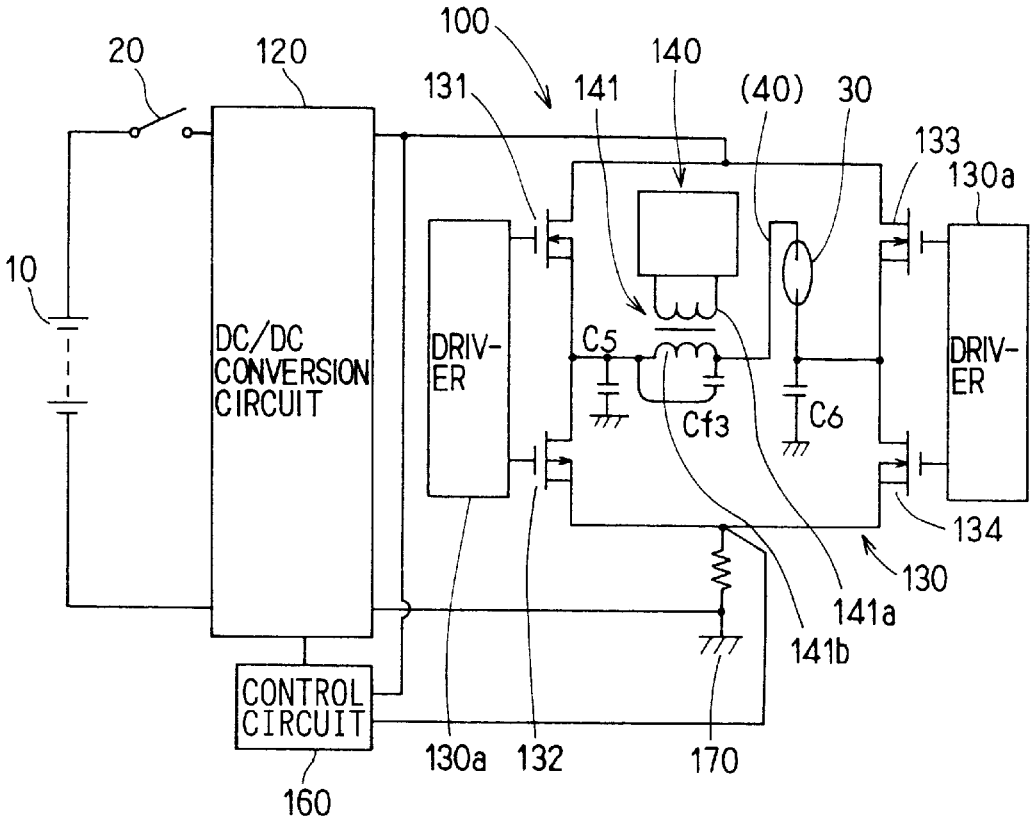
FIG. 5 is a block diagram showing the circuit configuration of the discharge lamp device according to the second embodiment.

As in a block diagram of FIG. 5 which shows the circuit configuration, the shield sheath 50 for covering the high voltage cord 40 can be omitted to eliminate the ground stray capacitance Cf1 resulting from the shield sheath structure. Besides, as shown in FIG. 4A, non exposure of the high voltage cord 40 prevents noise radiation resulting from the high voltage cord 40. Moreover, in the ballast 100 of the present embodiment, the electrode member 180 is interposed between the second transformer 141 and the metal case 170 as shown in FIG. 4B. This allows a reduction in stray capacitance occurring in the second transformer 141 (more specifically, the stray capacitance Cf3).

Consequently, the elimination of the ground stray capacitance Cf1 resulting from the shield sheath structure and the large reduction of stray capacitance in terms of the stray capacitance Cf3 resulting from the interposition of the electrode member 180 allow a reduction of, for example, the protective capacitors C1–C4 which have been arranged between the drains and sources of the respective MOS transistors 131–134 arranged in an H bridge.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A discharge lamp device comprising:

a lighting control circuit device including:

a DC/DC conversion circuit having a first transformer for boosting a direct current voltage from a direct current power source;

an inverter circuit having a semiconductor switching device for converting the voltage boosted by said DC/DC conversion circuit into an alternating current voltage;

a starting circuit having a second transformer for boosting to a voltage which causes a breakdown between electrodes of a discharge lamp in starting up said discharge lamp; and an electronic circuit case for accommodating said DC/DC conversion circuit, said inverter circuit, and said starting circuit, the discharge lamp device further comprising:

a secondary winding of said second transformer of said starting circuit that is connected between said discharge lamp and said inverter circuit connected to said discharge lamp, and an electrode member interposed between said second transformer and said electronic circuit case.

2. The discharge lamp device according to claim 1, wherein said electrode member is connected to a low-voltage side of said secondary winding of said second transformer.

3. The discharge lamp device according to claim 2, wherein said electrode member is an evaporated metal layer on an insulating film.

4. The discharge lamp device according to claim 2, wherein said electrode member is interposed at least between said secondary winding of said second transformer and said electronic circuit case.

5. The discharge lamp device according to claim 4, wherein said electrode member is an evaporated metal layer on an insulating film.

6. The discharge lamp device according to claim 5, wherein said electrode member is folded in two to cover both sides of said second transformer accommodated in said electronic circuit case.

7. The discharge lamp device according to claim 6, wherein said lighting control circuit is connected directly to said discharge lamp.

8. The discharge lamp device according to claim 1, wherein said electrode member is interposed at least between said secondary winding of said second transformer and said electronic circuit case.

9. The discharge lamp device according to claim 8, wherein said electrode member is an evaporated metal layer on an insulating film.

10. The discharge lamp device according to claim 1, wherein said electrode member is an evaporated metal layer on an insulating film.

11. The discharge lamp device according to claim 1, wherein said electrode member is folded in two to cover both sides of said second transformer accommodated in said electronic circuit case.

12. The discharge lamp device according to claim 1, wherein said lighting control circuit is connected directly to said discharge lamp.

13. The discharge lamp device according to claim 1 wherein the electrode member is isolated from the electronic circuit case.

* * * * *